United States Patent [19]

Burrell

[11] Patent Number: 4,534,260

[45] Date of Patent: Aug. 13, 1985

[54] STRING MUSICAL INSTRUMENT

[76] Inventor: Leo L. Burrell, Beaver, Pa.

[21] Appl. No.: 617,515

[22] Filed: Jun. 4, 1984

[51] Int. Cl.[3] ..... G10D 3/00

[52] U.S. Cl. ..... 84/293; 84/314 R

[58] Field of Search ..... 84/173, 267, 293, 314 R

[56] References Cited

U.S. PATENT DOCUMENTS 554,828 2/1896 Maldura ..... 84/314

1,290,177 1/1919 Grimson ..... 84/314

3,691,285 9/1972 Larrison ..... 84/293

*Primary Examiner*—Lawrence R. Franklin

*Attorney, Agent, or Firm*—William J. Ruano

[57] ABSTRACT

The present invention pertains to the string supporting assembly of various types of string musical instruments, typified by a guitar. Each string of the instrument is held in skew alignment relative to one or more of the respective strings supported by the assembly to make chording finger positions comfortable.

10 Claims, 11 Drawing Figures

STRING MUSICAL INSTRUMENT

This invention relates to a string musical instrument, such as a guitar.

BACKGROUND OF THE INVENTION

Instruments, typified by a guitar, as known in the art, are constructed such that the bridge and nut of the string supporting assembly are in the same plane. The strings held by the assembly are also in the same plane. This configuration can cause wrist and finger strain, particularly to a beginner.

An object of the invention is to align the assembly in such a way that chording finger positions will be comfortable. This is achieved by rotating the nut relative to the bridge. This configuration is comfortable because the strings are within easy reach of the chording hand.

Other objects and advantages of the invention will become more apparent from a study of the following description taken with the accompanying claims.

DETAILED DESCRIPTION OF THE INVENTION

Figure 1:
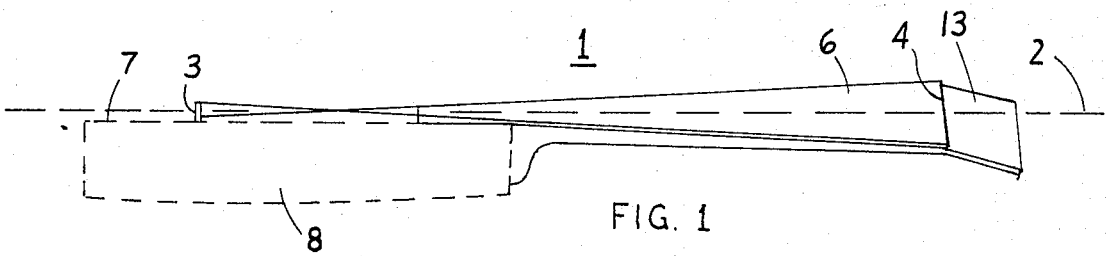
FIG. 1 is a side view of a string supporting assembly 1 applied to a guitar body 3 whose longitudinal axis is shown in dotted outline.

Referring to FIG. 1, numeral 1 generally denotes a string supporting assembly comprising a neck, fingerboard or fretboard 6 twisted about the longitudinal axis 2 of the assembly together with a bridge 3, nut 4, and head 13.

Figure 2:
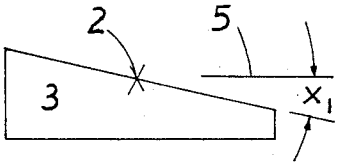
FIGS. 2, 3, and 4 show a bridge and nut of a right hand instrument relative to the axis of the string supporting assembly at different angles of rotation as viewed from the bottom of the nut end. A method of determining total rotation is defined as a total of the rotation of the two components relative to a line parallel to the face of the body of the instrument.

FIG. 2, numeral 3 is a flat topped bridge which is perpendicular to the axis 2 of the assembly 1. A reference line 5 is perpendicular to the axis and parallel to the top 7 of the body 8 of the instrument. The line 5 and the top of the bridge 3 intersect at the axis 2 to define the angle $x_1$ which is a measurement of the clockwise rotation of the bridge about the axis as viewed from the nut end.

Figure 3:
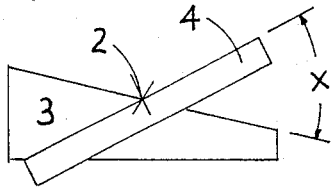

FIG. 3 shows a bridge 3 and nut 4 aligned with the axis 2 of the assembly 1. The intersection of the top of the bridge 3 and the top of the nut 4 defines the total rotation of the nut relative to the bridge as angle x.

Total rotation is indicated rather than specified since it is a variable that will change with the length of the assembly and the number of strings applied to any species of instrument under construction.

Typical total rotation for the assembly is between about 1° and 60°.

Figure 4:
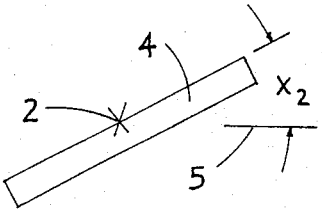

FIG. 4 shows nut 4 relative to the axis 2 of the assembly 1. The intersection of line 5 and the top of the nut 4 defines the counterclockwise rotation of the nut as angle $x_2$.

Figure 5:
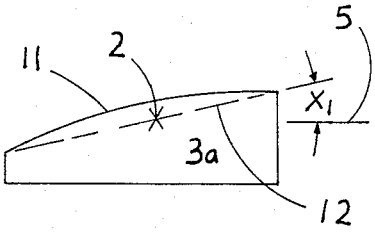
FIGS. 5, 6 and 7 show a crowned bridge and nut of a left hand instrument at different angles of rotation. Total rotation is calculated at the chord of the segment of the circle which represents the crown.

FIG. 5 shows a crowned bridge 3*a* of a left hand instrument wherein the crown 11 is a segment of a circle. The chord 12 of the segment intersects reference line 5 at the axis 2 to define the counterclockwise rotation of the bridge denoted by angle $x_1$ as viewed from the nut end of the assembly.

Figure 6:
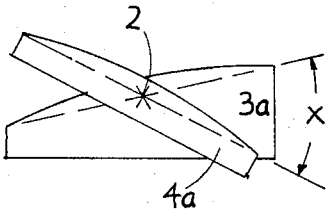

FIG. 6 shows both a crowned bridge 3*a* and crowned nut 4*a* having a common axis 2 and disposed at an angle x.

Figure 7:
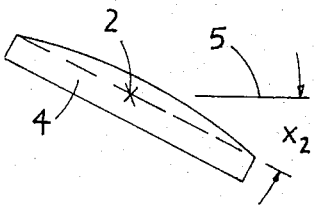

In FIG. 7, numeral 4 denotes a crowned nut relative to the assembly. The chord thereof intersects reference line 5 to define the clockwise rotation of the nut as angle $x_2$.

The four characteristics represented in the FIGS. 2 to 7 are:

1. A flat surface on the bridge and nut.
2. A crowned surface.
3. Clockwise rotation of the nut or bridge.
4. Counterclockwise rotation A skew alignment of the strings can be similarly achieved by rotating both bridge and nut in the same direction but by unequal amounts.

Figure 8:
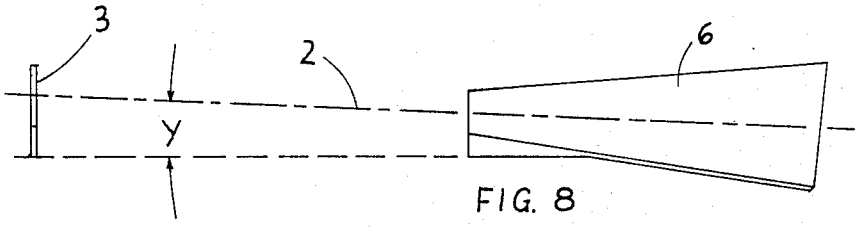
FIGS. 8 and 9 are schematic views which show the effect of the bridge and nut rotation on the shape of the fretboard.

In FIG. 8, numeral 3 represents a bridge mounted on the face 7 of the body of a string instrument. The fretboard or freboard/neck integral unit 6 is a twisted shape which conforms to the pattern of the strings. The axis 2 of the assembly 1 may be parallel with the body, or angled Y relative to the body. This relationship of the strings to the body will vary as the rotation of the assembly varies.

Figure 9:
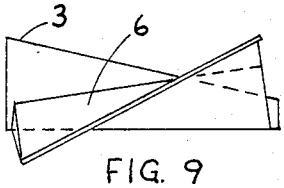

FIG. 9 represents a view of a typical fretboard 6 from the nut end. A bridge 3 is shown on the far side. The shape of the fretboard and neck varies as the rotation of the assembly varies, and as the length of the assembly varies, and as the relationship of the assembly to the body varies.

Figure 10:
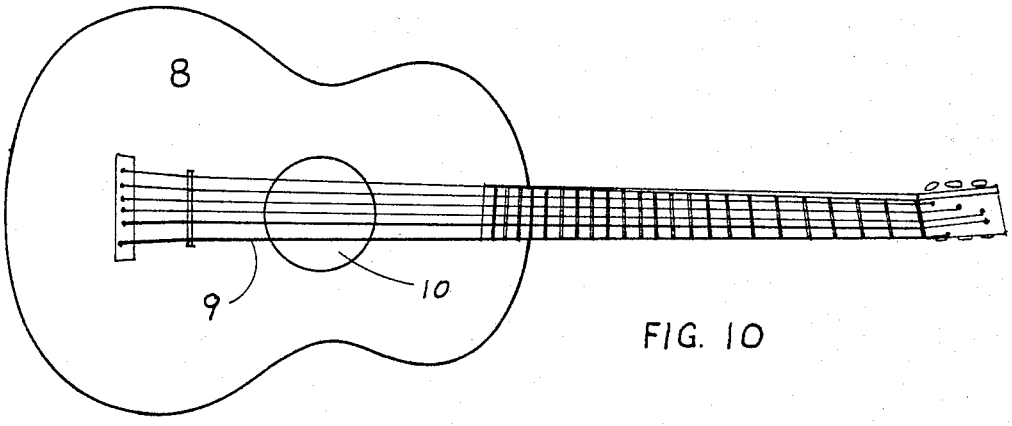
FIG. 10 is a top view and FIG. 11 is a side view of a typical string instrument, such as a guitar, and which show that while the strings are twisted into a comfortable configuration at the nut end of the assembly, they are nearly cross-sectionally parallel to the body at the point where they pass over the sound hole, which alignment over the sound hole is comfortable for picking and strumming.

FIG. 10 represents a typical string musical instrument, such as a guitar, comprising a body 8 and a string supporting assembly, and strings 9. The strings are aligned over the sound hole 10.

Figure 11:
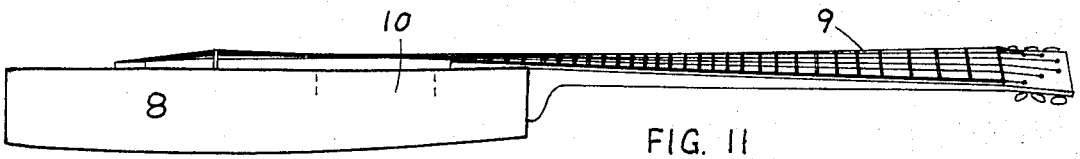

FIG. 11 represents a typical right hand instrument. The strings 9 are nearly cross-sectionally parallel to the face or top 7 of the body 8 over the sound hole 10. This relationship of the strings to the body is variable and a factor of the rotation of the bridge and nut.

Several variables have been described. The lead design variables are the rotation of the bridges about the axis of the assembly, and the rotation of the assembly relative to the body of the instrument. A second design variable, the relationship of the strings to the body, is limited by the strength of the materials. All other variables are defined by the design variables. The instrument is not adjustable. That is, once it is built, the configuration of the instrument is fixed.

Thus it will be seen that I have provided a novel and highly efficient string musical instrument having a twisted fretboard which eliminates wrist strain, particularly for beginning artists and makes it possible for the artist to free his eyes to look at the audience by learning to play by touch rather than by sight.

While I have illustrated and described several specific embodiments of my invention, it will be understood that these are by way of illustration only and that various changes and modifications may be contemplated in my invention within the scope of the following claims.

I claim:

1. A string musical instrument comprising a body and fretboard having substantially aligned longitudinal center-lines, a string supporting assembly, including a bridge on one end of said instrument and a nut and head on the other end thereof, said bridge and nut being rotated, one relative to the other, about the longitudinal axis of said assembly, said fretboard being twisted progressively throughout its length to correspond to said rotation, and a plurality of strings mounted on said assembly and disposed at progressively varying angles to the top surface of said body throughout said longitudinal axis, whereby chording finger positions are made comfortable.

2. A string musical instrument as recited in claim 1 wherein the rotation of said nut about said axis relative to said bridge varies between about 1° to 60°.

3. An instrument as recited in claim 2 wherein said rotation of said nut relative to said bridge is clockwise.

4. An instrument as recited in claim 2 wherein said rotation of said nut relative to said bridge is counter-clockwise.

5. an instrument as recited in claim 2 wherein said longitudinal axis of said assembly is not parallel to the face of said body.

6. An instrument as recited in claim 2 wherein any two or more of said strings are not parallel and not in the same plane.

7. An instrument as recited in claim 1 wherein said fretboard has substantially the same cross-section throughout its length an devoid of enlargements of any portion of its top surface.

8. An instrument as recited in claim 1 wherein said body has a sound hole and wherein strings are substantially cross-sectionally parallel to the face of said body only over said sound hole and are otherwise longitudinally twisted.

9. An instrument as recited in claim 1 wherein said bridge and nut have top flat surfaces.

10. An instrument as recited in claim 1 wherein said bridge and nut have curved top surfaces.

* * * * *